US009394633B2

(12) United States Patent
Shimotsu et al.

(10) Patent No.: US 9,394,633 B2
(45) Date of Patent: Jul. 19, 2016

(54) FIBER BUNDLE

(75) Inventors: Yukiharu Shimotsu, Osaka (JP); Takayuki Nishitani, Osaka (JP)

(73) Assignees: ES FIBERVISIONS CO., LTD., Osaka (JP); ES FIBERVISIONS HONG KONG LIMITED, Kowloon (HK); ES FIBERVISIONS LP, Georgia; ES FIBERVISIONS APS, Varde (DK)

( * ) Notice: Subject to any disclaimer, the term of this patent is extended or adjusted under 35 U.S.C. 154(b) by 798 days.

(21) Appl. No.: 13/141,259

(22) PCT Filed: Dec. 25, 2009

(86) PCT No.: PCT/JP2009/071896

§ 371 (c)(1),
(2), (4) Date: Jun. 21, 2011

(87) PCT Pub. No.: WO2010/074344

PCT Pub. Date: Jul. 1, 2010

(65) Prior Publication Data

US 2011/0256399 A1 Oct. 20, 2011

(30) Foreign Application Priority Data

Dec. 26, 2008 (JP) ..... 2008-334576

(51) Int. Cl.
*D01F 8/04* (2006.01)
*D02G 3/22* (2006.01)
(Continued)

(52) U.S. Cl.
CPC .. *D02G 1/18* (2013.01); *D02G 1/12* (2013.01); *D02J 1/18* (2013.01); *D01F 8/00* (2013.01);
(Continued)

(58) Field of Classification Search
CPC ..... D02G 1/18; D02G 1/12; D02J 1/18; Y10T 428/2922; Y10T 428/2924; A47L 13/20
USPC ..... 428/369–370, 373–374, 295.7, 298.4, 428/362; 57/245, 205, 208, 226, 227, 228, 57/239, 246, 247, 254, 351; 442/352–360; 28/221, 247–281, 286
See application file for complete search history.

(56) References Cited

U.S. PATENT DOCUMENTS 3,034,196 A * 5/1962 Bohmfalk ..... 442/189
5,338,500 A 8/1994 Halm et al.
(Continued)

FOREIGN PATENT DOCUMENTS

CN 1136098 11/1996
CN 1489650 4/2004
(Continued)

OTHER PUBLICATIONS

Comfil, "Polymer Types", access May 9, 2014, <www.comfil.biz/matrix-polymers.php.*

*Primary Examiner* — Jennifer Chriss
*Assistant Examiner* — Frank Vineis
(74) *Attorney, Agent, or Firm* — Hamre, Schumann, Mueller & Larson, P.C.

(57) ABSTRACT

A fiber bundle is provided that strikes an excellent balance among the properties and performance of the web and articles manufactured using this web, the productivity, processability, and cost. The fiber bundle comprising continuous fibers aligned in one direction is characterized in that the continuous fibers have crimps that form peaks and valleys in the width direction of the fiber bundle, and these crimps have a characteristic value A, defined as the absolute value of a slope with respect to the length direction of the fiber bundle of a straight line that connects the vertex of the peak with the vertex of the valley of adjacent crimps present in a single continuous fiber, of at least 0.3.

6 Claims, 1 Drawing Sheet

(51) Int. Cl.

| | |
|---|---|
| ***D02G 3/04*** | (2006.01) |
| ***D02G 1/12*** | (2006.01) |
| ***D02G 1/18*** | (2006.01) |
| ***D02J 1/18*** | (2006.01) |
| *D01F 8/00* | (2006.01) |

(52) U.S. Cl.
CPC ..... *D10B 2321/02* (2013.01); *D10B 2331/02* (2013.01); *D10B 2331/04* (2013.01); *Y10T 428/2922* (2015.01); *Y10T 428/2924* (2015.01)

(56) References Cited

U.S. PATENT DOCUMENTS

| | | | |
|---|---|---|---|
| 5,701,644 | A | 12/1997 | Kaegi et al. |
| 7,003,856 | B2 | 2/2006 | Hayashi et al. |
| 7,732,093 | B2 | 6/2010 | Xiao et al. |
| 2002/0026699 | A1 | 3/2002 | Hayashi et al. |
| 2002/0119312 | A1 | 8/2002 | Iwata et al. |
| 2004/0234757 | A1 | 11/2004 | Goda |
| 2006/0182964 | A1 | 8/2006 | Goda |
| 2007/0105022 | A1 | 5/2007 | Xiao et al. |
| 2009/0208699 | A1 | 8/2009 | Miyauchi et al. |
| 2009/0243141 | A1 | 10/2009 | Goda |
| 2010/0088837 | A1 * | 4/2010 | Wada et al. ..... 15/209.1 |

FOREIGN PATENT DOCUMENTS

| | | |
|---|---|---|
| EP | 1452633 | 9/2004 |
| EP | 1988201 | 11/2008 |
| JP | 09-273037 | 10/1997 |
| JP | 2000-254057 | 9/2000 |
| JP | 2000-254059 | 9/2000 |
| JP | 2002-266240 | 9/2002 |
| JP | 2007-204899 | 8/2007 |
| JP | 2008-063712 | 3/2008 |
| KR | 2002-0082392 | 10/2002 |
| KR | 10-0954704 | 4/2010 |
| TW | I353401 | 12/2008 |
| WO | 2007/105503 | 9/2007 |
| WO | 2008/018635 | 2/2008 |
| WO | WO 2008136424 A1 * | 11/2008 |

* cited by examiner

FIBER BUNDLE

TECHNICAL FIELD

The present invention relates to a fiber bundle that exhibits an excellent bundlability and an excellent spreading property. More particularly, the present invention relates to a fiber bundle that exhibits an excellent high-speed spreading property and that can be processed into a nonwoven fabric in which the spread web is uniform and has an excellent handle. The fiber bundle of the present invention can be used, by itself or laminated or intermixed with another member such as a nonwoven fabric, film, pulp, and so forth, for various kinds of packaging and wrapping materials, patching, bandages, adhesive skin patches, cushioning materials, heat insulating materials, and so forth.

BACKGROUND ART

Thermoplastic conjugate fibers, for example, PE/PP, PE/PET, PP/PET, and so forth, are used for the surface layer of adsorbent products such as sanitary napkins and for the wiping elements of mops and wiping materials for cleaning applications. Webs formed by spreading a continuous fiber bundle can be used for them.

In a continuous fiber bundle, crimped continuous fibers are gathered so as to cohere with each other, thereby providing a high fiber density. When this continuous fiber bundle is to be processed into the previously mentioned surface layer or wiping member, the production sequence proceeds through a step in which the continuous fibers constituting the fiber bundle are separated from each other in the width direction to broaden out the bulk width, that is, a spreading step. A web in which the continuous fibers have been loosened from each other, and thus which has a low fiber density, can be obtained by this spreading step from a high fiber density fiber bundle in which the continuous fibers are bundled or gathered with each other. The surface layer or wiping element is produced from the resulting web having an approximately uniform thickness and handle in the width direction.

Various tactics are employed in order to obtain a uniform web by the spreading of a fiber bundle. For example, Patent Reference 1 teaches that a fiber bundle having sensible crimps and/or latent crimps, a single filament fineness of 0.5 to 100 denier, a total fineness of 10,000 to 300,000 denier, and a sensible crimp count of 10 to 50 peaks/25 mm, provides a suitable range for the spread width upon draw-spreading and can be uniformly spread at high speeds and thereby provides a web with an excellent handle at high productivities. However, a fiber bundle that exhibits a more stable spreading behavior has been in demand.

[Patent Reference 1] Japanese Patent Application Publication No. 1109-273037

DISCLOSURE OF THE INVENTION

It is known that a fiber bundle showing high spreading property is essential for obtaining a uniform web with an excellent handle at high productivities. Such fiber bundles are obtained by selecting the constituent resin of the fiber bundle and establishing the spinning, drawing, and crimping conditions through a trial-and-error design. However, since a trial-and-error design is required in order to obtain a fiber bundle having the desired high spreading property, this is still unsatisfactory from the standpoint of obtaining, at good productivities, a fiber bundle having a stable and high spreading property.

The problem to be solved by the present invention is to provide a fiber bundle that strikes an excellent balance among the properties and performance of the web and articles manufactured using this web and the productivity, processability, and cost. Specifically, the problem to be solved by the present invention is to obtain, through the use of a fiber bundle comprising continuous fibers that have crimps that form peaks and valley in the width direction of the fiber bundle wherein these crimps are sufficiently bent, a uniform web with an excellent handle by carrying out, by a suitable draw and relaxation in the spreading step, a stable spreading in the direction of these crimps, i.e., in the width direction of the fiber bundle, of a fiber bundle bundled to a high fiber density in the packing, distribution, and pull up steps.

As a result of extensive and intensive investigations in order to solve the problem identified above, the present inventors discovered that, by having the crimps in the continuous fibers constituting the fiber bundle form peaks and valleys in the width direction of the fiber bundle and by having these crimps be adequately bent, the packing and handling behavior of the fiber bundle prior to spreading is excellent because bundling at a high fiber density is obtained and, when a suitable drawing and relaxation are carried out in the ensuing spreading step, an excellent spreading behavior is obtained because the adjacent fibers spread out jointly due to the direction of the crimps. It was also discovered that the resulting spread web was uniform and had an excellent handle. The present invention was achieved based on these discoveries.

The present invention therefore has the following structure.

(1) A fiber bundle comprising continuous fibers aligned in one direction, the fiber bundle being characterized in that the continuous fibers have crimps that form peaks and valleys in the width direction of the fiber bundle, and the crimps have a characteristic value A, defined as the absolute value of a slope with respect to the length direction of the fiber bundle of a straight line that connects the vertex of the peak with the vertex of the valley of adjacent crimps present in a single continuous fiber, of at least 0.3.

(2) The fiber bundle according to (1) above, characterized in that the crimps formed by the peaks and valleys in the width direction of the fiber bundle and having the characteristic value A of at least 0.3 are intermittently disposed along the length direction of the fiber bundle.

(3) The fiber bundle according to (1) or (2) above, characterized in that the characteristic value A of the crimps formed in the width direction of the fiber bundle is at least 1.0.

(4) The fiber bundle according to any of (1) to (3) above, characterized in that the single filament fineness of the fibers constituting the fiber bundle is 0.5 to 100 decitex (dtex).

(5) The fiber bundle according to any of (1) to (4) above, characterized in that the total fineness of the fiber bundle is 5,000 to 2,000,000 decitex (dtex).

(6) The fiber bundle according to any of (1) to (5) above, characterized in that the fiber constituting the fiber bundle is at least one thermoplastic fiber selected from polyolefin-type fibers, polyester-type fibers, and polyamide-type fibers.

(7) The fiber bundle according to any of (1) to (6) above, characterized in that the fiber constituting the fiber bundle is a conjugate fiber that contains at least two thermoplastic resin components that have melting points that differ by at least 15° C.

The fiber bundle of the present invention provides an excellent packing and handling behavior because prior to spreading it is bundled into a high fiber density state due to the fact that the continuous fibers constituting the fiber bundle have crimps that form peaks and valleys in the width direction of the fiber bundle wherein these crimps are adequately bent.

In addition, the inventive fiber bundle with the characteristics indicated above, when subjected to a suitable draw and relaxation in the spreading step, exhibits a stable and excellent spreading behavior because the fiber interval next to each other is easy to be extended by the force of the suitable draw and relaxation due to the direction of the crimps. Furthermore, the spread web obtained from the fiber bundle of the present invention is uniform and has an excellent handle is therefore well adapted for use for the surface of adsorbent products and for wiping elements, filters, and the like.

BEST MODE FOR CARRYING OUT THE INVENTION

Figure 1:
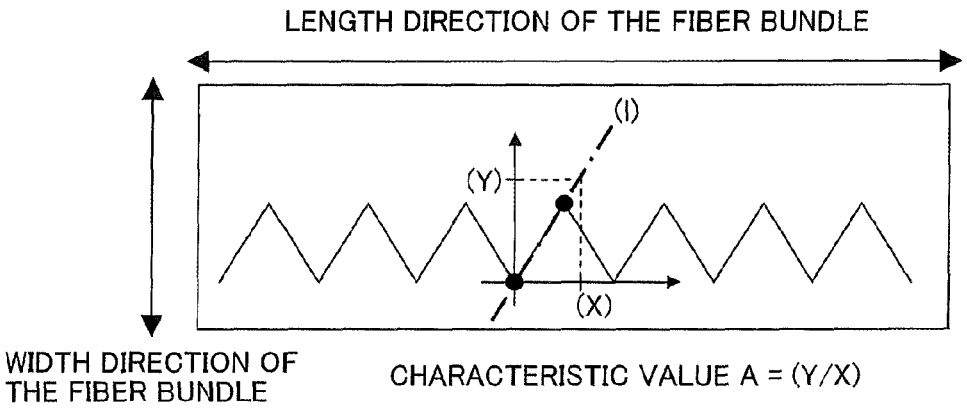
FIG. 1 is a diagram that explains the characteristic value A of the fiber bundle of the present invention.

The present invention is explained in detail herebelow based on embodiments of the invention.

The fiber bundle of the present invention is a fiber bundle in which continuous fibers are aligned in one direction. There are no particular limitations on the continuous fibers that constitute this fiber bundle, and these continuous fibers may be a natural fiber, semisynthetic fiber, or synthetic fiber. Based on a consideration of being able to impart a hot-bonding behavior, e.g., heat sealability, to the spread web, within the synthetic fiber context the continuous fibers are preferably a thermoplastic fiber comprising a thermoplastic resin. This thermoplastic fiber is a thermoplastic fiber yielded by the melt spinning of, for example, polyolefin, e.g., polyethylene, polypropylene, binary copolymers to tetrapolymers with other α-olefins in which the major component is propylene, polymethylpentene, and so forth; polyamides as typified by nylon-6, nylon-66, and so forth; polyesters as typified by polyethylene terephthalate, polytrimethylene terephthalate, polybutylene terephthalate, low melting polyesters in which, e.g., isophthalic acid, is copolymerized as the acid component, polyester elastomers, and so forth; and fluororesins. Viewed from the perspective of lowering the environmental burden, thermoplastic fibers yielded by the melt spinning of a biodegradable resin, e.g., polylactic acid, polybutylene succinate, polybutylene adipate terephthalate, and so forth, are also suitably used. Viewed from the perspective of improving the handle of the web provided by the spreading of the fiber bundle, elastomeric resins, e.g., styrenic elastomers as typified by styrene-ethylenebutylene-styrene block copolymers, olefinic elastomers, ester-type elastomers, urethane-type elastomers, and so forth, are also suitably used.

Furthermore, a thermoplastic conjugate fiber provided by conjugating thermoplastic resin components that have different melting points is preferred from the perspective of improving the handle of sheet in which the web yielded by spreading the fiber bundle is hot bonded. The following combinations are examples of this combination of thermoplastic resin components that have different melting points: high density polyethylene/polypropylene, high density polyethylene/polyethylene terephthalate, polypropylene/polyethylene terephthalate, polylactic acid/polyethylene terephthalate, polybutylene terephthalate/polyethylene terephthalate, nylon-6/polyethylene terephthalate, high density polyethylene/nylon-66, polypropylene/nylon-66, high density polyethylene/polymethylpentene, and so forth. The melting point difference is preferably at least 20° C. and more preferably is at least 50° C. Hot bonding is carried out at a temperature at which the lower melting component softens or melts and at which the higher melting component does not melt; however, the temperature difference is preferably at least 20° C. because hot bonding can then be performed unaccompanied by significant heat shrinkage of the higher melting component since heating is made possible at a temperature well below the melting point of the higher melting component. A temperature difference of at least 50° C. is more preferred because this makes it possible to set the hot-bonding temperature well above the melting point of the lower melting component and thereby improves the productivity in connection with, for example, a shortening of the heat-sealing time interval.

The mass proportion of the higher melting component in this thermoplastic conjugate fiber is 10 to 90 mass % and preferably 30 to 70 mass %. The higher melting component is preferably at least 10 mass % because the thermoplastic conjugate fiber can then undergo bonding during hot bonding, for example, heat sealing, without excessive shrinkage. A satisfactory hot bonding strength is obtained when the higher melting component is not more than 90 mass % and not more than 90 mass % is therefore preferred. An excellent balance between adhesive strength and shape retention during hot bonding is obtained when the higher melting component is in the range from 10 to 90 mass %, while an even better balance is obtained when the higher melting component is in the range from 30 to 70 mass %. There are no particular limitations on the number of conjugate components, and bicomponent conjugate fibers and conjugate fibers having three or more components are entirely unproblematic. A single thermoplastic resin as described above may be used or a mixture of two or more types may be used. Viewed from the perspective of obtaining a fiber bundle that has the excellent spreading property that is a characteristic feature of the present invention, choice of a resin is important that exhibits a satisfactory spreading behavior in the spreading step while being resistant to the occurrence of agglutination in the crimping step. Examples of combinations of this nature are high density polyethylene/polypropylene, high density polyethylene/polyethylene terephthalate, polypropylene/polyethylene terephthalate, and so forth.

The continuous fibers constituting the fiber bundle of the present invention may contain, within a range that does not impair the effects of the present invention, oxidation inhibitors, photostabilizers, ultraviolet absorbers, neutralizing agents, nucleating agents, epoxy stabilizers, lubricants, antimicrobials, deodorizers, flame retardants, static inhibitors, pigments, plasticizers, other thermoplastic resins, and so forth, as additives.

The fiber bundle of the present invention may be constituted of one type of continuous fiber or may be constituted of two or more types of continuous fibers. With regard to fiber bundles constituted of two or more types of continuous fibers, there are no particular limitations on the continuous fiber mixing regime and mixing may be random, or in parallel in the width direction of the fiber bundle, or layerwise in the thickness direction. The different types of continuous fibers may differ, for example, in the fiber materials, cross-sectional shape, single filament fineness, single filament elongation, crimp count, crimp shape, crimp direction, and additives.

Combinations of at least two types of continuous fibers that have different fiber materials can be exemplified by combinations of at least two fibers selected from the group consisting of polyolefins, polyesters, and polyamides. Specific examples here are polyethylene/rayon, nylon/polyethylene terephthalate, polypropylene/polyethylene terephthalate, polybutylene succinate/polylactic acid, and so forth.

Combinations of at least two types of continuous fibers with different cross-sectional shapes can be exemplified by solid/hollow, circular/triangular, star-shaped/flattened, and so forth.

Combinations of at least two types of continuous fibers with different single filament finenesses can be exemplified by the fine fineness/thick fineness combination and so forth. Combinations of at least two types of continuous fibers with different single filament elongations can be exemplified low elongation fiber/high elongation fiber, elastic fiber/plastic fiber, and so forth.

Combinations of at least two types of continuous fibers with different crimp counts can be exemplified by combinations such as high crimp count continuous fibers/low crimp count continuous fibers and so forth.

Combinations of at least two types of continuous fibers with different crimp shapes can be exemplified by combinations such as Ω-shaped crimps/zigzag crimps, spiral crimps/zigzag crimps, and so forth. Combinations of at least two types of continuous fibers with different crimp directions can be exemplified by the combination of continuous fibers in which the crimps are formed in the width direction of the fiber bundle with continuous fibers in which the crimps are formed in the thickness direction of the fiber bundle, and so forth.

Combinations of at least two types of continuous fibers in which the additives differ can be exemplified by continuous fibers that have different, for example, oxidation inhibitors, photostabilizers, ultraviolet absorbers, neutralizing agents, nucleating agents, epoxy stabilizers, lubricants, antimicrobials, deodorizers, flame retardants, static inhibitors, pigments, plasticizers, and other thermoplastic resins used as additives.

The fiber bundle of the present invention is constituted of crimped continuous fibers and is characterized in that these continuous fibers have crimps that form peaks/valleys in the width direction of the fiber bundle wherein these crimps have a characteristic value A, defined as the absolute value of the slope with respect to the length direction of the fiber bundle of a straight line that connects the vertex of the peak with the vertex of the valley of adjacent crimps present in a single continuous fiber, of at least 0.3. More specifically, 50 points are randomly selected at which a crimp in the continuous fibers in the fiber bundle forms a peak/valley in the width direction of the fiber bundle; at each crimp, and as shown in FIG. 1, a determination is made of the absolute value of the slope with respect to the length direction of the fiber bundle of a straight line (l) that connects the vertex of a valley with the vertex of an adjacent peak present in one and the same continuous fiber; and the characteristic value A is defined as the average value of the absolute values for the 50 points.

More particularly, the absolute value for the crimp at each of the aforementioned points in the fiber bundle is the absolute value of the ratio of (Y) to (X) (Y/X) as shown in FIG. 1, and the average value of this absolute value at the aforementioned 50 points (i.e., the characteristic value A) is at least 0.3 in the fiber bundle of the present invention and more preferably is at least 1.0 and even more preferably is at least 1.6.

By having this characteristic value A be at least 0.3, the adjacent fibers are spread out jointly when a suitable draw and relaxation are carried out in the spreading step, which results in a thorough spreading in the width direction and causes the resulting spread web to be uniform and to have an excellent handle. At least 1.0 is preferred because a greater effect is obtained when the characteristic value A is at least 1.0, while at least 1.6 is even more preferred. In addition, as long as the characteristic value A is at least 0.3, the crimps may be present continuously or intermittently in the length direction of the fiber bundle.

Figure 2:
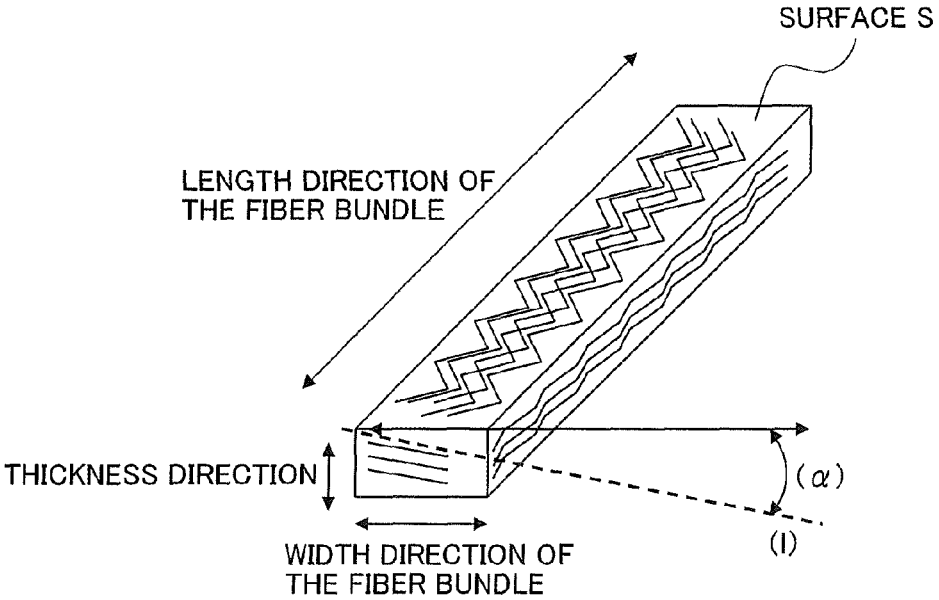
FIG. 2 is a schematic diagram that illustrates the fiber bundle of the present invention.

In the present invention, the fibers having crimps in which the peaks/valleys are formed in the width direction of the fiber bundle denote fibers that have a value of not more than 45° for the inclination (α) of the straight line (l) (refer to FIG. 1) with respect to the surface S of the fiber bundle as shown in FIG. 2. When α is not more than 45°, the adjacent fiber joint outspreading effect, which is caused by the direction of the crimps and is a characteristic feature of the present invention, is readily and efficiently obtained, and because of this the spreading behavior is excellent and the resulting spread web is uniform and has an excellent handle. It is for these reasons that an α of not more than 45° is preferred. An α of not more than 30° is preferred because this provides an even greater effect.

The length direction, width direction, thickness direction, and surface S in the fiber bundle have the customary designations. Thus, when, for example, the fiber bundle is placed in an xyz coordinate system, the z axis becomes the thickness direction of the fiber bundle when the x axis is made the long direction of the fiber bundle and the y axis is made the width direction of the fiber bundle. Here, the y axis and z axis are set by the width and height of the crimping device, and generally length of y>length of z. In this case, the surface S is identified as the fiber bundle surface that is in the x-y plane.

The fiber bundle of the present invention may comprise only continuous fibers in which the peaks/valleys of the crimps are directed in the width direction or may comprise a mixture of continuous fibers in which the peaks/valleys of the crimps are directed in the width direction and continuous fibers in which the peaks/valleys of the crimps are directed in the thickness direction.

In addition, crimps in which the peaks/valleys are formed in the width direction may be mixed, in any cross section in the length direction of the fiber bundle, with crimps in which the peaks/valleys are formed in the thickness direction.

The crimps that form peaks/valleys in the width direction of the fiber bundle preferably comprise at least 35% of the number of crimps in the fiber bundle as a whole and more preferably comprise at least 55%. This percentage in the fiber bundle of crimps that form peaks/valleys in the width direction of the fiber bundle can be determined by checking the α value (the inclination (degrees) of the straight line (l) with respect to the surface S of the fiber bundle as shown in FIG. 2), which governs the direction of the crimps, in the fiber bundle cross section at random points along the length direction.

The crimp count in any continuous fiber in which the peaks/valleys are formed in the width direction of the fiber bundle is 8 to 30 peaks/2.54 cm, preferably 10 to 20 peaks/2.54 cm, and more preferably 12 to 18 peaks/2.54 cm. A crimp count larger than 8 peaks/2.54 cm is preferred from the standpoints of providing the fiber bundle with a good bundlability, ensuring packability into the packing container, providing a smooth pull up and reducing problems due to breakage and fraying within the fibers when the fiber bundle is pulled up from the packing container, and providing a stable and consistent spreading process. A crimp count smaller than 30 peaks/2.54 cm is preferred from the standpoint of inhibiting coiling, twisting, and compaction among the continuous fibers. In addition, when one considers crimping, a crimp count of not more than 30 peaks/2.54 cm is also preferred from the standpoints of not requiring the application of excessive pressure to the fiber bundle in the crimper process, securing crimp uniformity, and reducing the risk of causing agglutination among the fibers.

There are no particular limitations on the crimping method, and this method can be exemplified by (1) methods in which crimps that form peaks/valleys in the width direction of the fiber bundle are generated by a crimping process in fiber that is substantially uncrimped, and (2) methods in which crimps that form peaks/valleys substantially in the thickness direction of the fiber are first introduced and the crimps in the thickness direction of the fiber bundle are then caused to be directed in the width direction of the fiber bundle.

Considering crimp introduction methods according to (1) above and taking the use of an apparatus such as a stuffing box-type crimper as an example, the fiber bundle is passed between juxtaposed rolls associated with the front section of the crimper in order to bring about the stable entry of the fiber bundle into the flow path of the crimper, after which crimps can be generated by discharging the fiber bundle from the crimping device while applying a prescribed pressure from the width direction of the fiber bundle. There are no particular limitations on this "prescribed pressure", but it is preferably in the range from 0.01 to 1.00 MPa. A pressure of 0.08 to 0.20 MPa is preferably applied during passage between the juxtaposed rolls in order to inhibit agglutination between the fibers in the fiber bundle and achieve a stable high-speed introduction of the fiber bundle into the flow path of the crimper.

There are no limitations on the crimp introduction methods according to (2) above. As an example, a fiber bundle comprising fibers having crimps that form peaks/valleys in the thickness direction is discharged from an apparatus such as the usual stuffer box-type crimper, and, by the disposition of a process in which stress is applied to this fiber bundle from the width direction of the fiber bundle or from an oblique direction, the crimps that form peaks/valleys in the thickness direction of the fiber bundle can be converted to crimps that have peaks/valleys in the width direction of the fiber bundle. There is no limitation on the stress application process, and, for example, a nip roll stress application process can be used or the box pressure in a stuffing box can be used.

The continuous fibers constituting the fiber bundle of the present invention have a strength preferably of at least 1.0 cN/dtex and more preferably at least 1.3 cN/dtex. At a strength of at least 1.0 cN/dtex, the crimping elasticity of the fiber is increased and, when a suitable draw and relaxation are carried out in the spreading step, the adjacent fiber joint outspreading effect, which is a characteristic feature of the present invention, is readily and efficiently obtained, and because of this the spreading behavior is excellent and the resulting spread web is uniform and has an excellent handle. It is for these reasons that a strength of at least 1.0 cN/dtex is preferred. At least 1.3 cN/dtex is preferred because this efficiently provides an even greater effect.

The single filament fineness of the continuous fiber constituting the fiber bundle of the present invention is preferably 0.5 to 100 dtex, more preferably 1.0 to 70 dtex, and even more preferably in the range from 2.0 to 30 dtex. A single filament fineness greater than 0.5 dtex is preferred because this increases the filament strength exhibited by the single filament and inhibits single filament snapping and napping during spreading and thereby makes it possible to carry out spreading at high productivities. A single filament fineness less than 100 dtex is preferred because this secures bundlability for the fiber bundle and makes it possible to prevent entanglement during fiber bundle pull up and to avoid impairing the spreading behavior. When the single filament fineness is in the range from 0.5 to 100 dtex, a satisfactory fiber strength, satisfactory bundlability by the fiber bundle, and satisfactory spreading behavior are obtained, while a single filament fineness in the range from 1.0 to 70 dtex provides higher levels for these properties and a single filament fineness in the range from 2.0 to 30 dtex provides an even better fiber strength, bundlability by the fiber bundle, and spreading behavior.

The total fineness of the fiber bundle of the present invention is preferably 5,000 to 2,000,000 dtex, more preferably 20,000 to 1,000,000 dtex, and even more preferably 40,000 to 500,000 dtex. A total fineness of more than 5,000 dtex is preferred because the number of continuous fibers constituting the fiber bundle then becomes sufficiently large that the bundlability is increased and uniformity upon spreading is ensured. A total fineness less than 2,000,000 dtex is preferred from the standpoint of inhibiting twisting, entangling, and intertwining of the fiber bundle. When the total fineness is in the range of 5,000 to 2,000,000 dtex, processing can be carried out in a stable manner without the appearance of the problems cited above, while the ranges of 20,000 to 1,000,000 dtex and more preferably 40,000 to 500,000 dtex are desirable because these ranges make it possible to carry out processing at high speeds.

There are no particular limitations on the shape of the fiber cross section of the continuous fibers that constitute the fiber bundle of the present invention, and a circular cross section, irregular or special cross sections, and hollow cross sections are entirely unproblematic. For example, various types of cross-sectional shapes can be generated by a suitable selection of the spinneret shape.

When the continuous fiber constituting the fiber bundle is a conjugate fiber, it may be a sheath-core type, eccentric type, parallel type, sea-island type, or splittable multicomponent type.

There are no particular limitations on the method of spreading the fiber bundle of the present invention. Methods for spreading the fiber bundle can be exemplified by methods in which spreading is carried out by applying elongation and contraction to the crimps by applying tension to the fiber bundle between pinch rolls having different velocities and then carrying out elastic shrinkage and methods in which the fiber bundle is held between a pair of pinchcocks and elongation and contraction are mechanically applied to the fiber bundle.

An spreading method that uses three pinch rolls having different velocities is particularly preferred among the preceding from the standpoint of being able to carry out a high-productivity spreading while executing a suitable draw on the continuous fibers constituting the fiber bundle. Here, there is no particular limitation on the velocity of the second pinch roll with respect to the velocity of the first pinch roll, but the range, i.e. the draw ratio of the velocity of the second pinch roll with respect to the velocity of the first pinch roll, of 1.2 to 3.0 makes it possible to carry out spreading of the fiber bundle of the present invention at high productivities. There is also no particular limitation on the velocity of the third pinch roll with respect to the velocity of the second pinch roll, but the range, i.e. the draw ratio of the velocity of the third pinch roll with respect to the velocity of the second pinch roll, of 0.8 to 0.9 is preferred because the web obtained by spreading the fiber bundle of the present invention is then uniform and has an excellent handle.

A nonwoven fabric that exhibits an excellent texture and an excellent handle can be obtained by processing the uniform web having an excellent handle that is obtained by spreading the fiber bundle of the present invention.

Procedures for processing the web into a nonwoven fabric can be exemplified by spunlace methods and resin bonding methods. Additional examples when the web comprises a thermoplastic fiber are point-bonding methods and air-through methods. Air-through methods are particularly well suited for use from the standpoint of capitalizing on the properties of the uniform web having an excellent handle that is obtained by spreading the fiber bundle of the present invention.

EXAMPLES

The present invention is explained in detailed below by examples, but the present invention is not limited by these examples. The definitions of and methods of measuring the property values shown in the examples are given below. (1) to (8) concern evaluation and measurement methods for the obtained fiber bundle, while (9) and (10) are evaluation methods for the web materials obtained by spreading the obtained fiber bundles in a spreading step.

(1) Single Filament Fineness

The single filament fineness was measured according to JIS-L-1015.

(2) Single Filament Strength

The single filament strength was measured according to JIS-L-1015.

(3) Total Fineness

This was calculated from the single filament fineness and the number of continuous fibers constituting the fiber bundle.

(4) Crimp Count

The crimp count was measured according to JIS-L-1015 on the crimped continuous fibers.

(5) Crimp Direction

Randomly selected cross sections of the fiber bundle were photographed, for example, with a microscope, and the $\alpha$ value (degrees) (see FIG. 2), which determines the crimp direction, was evaluated. When crimps that formed peaks/valleys in the width direction of the fiber bundle, i.e., crimps for which the value of a was not more than 45°, were at least 55% of the number of crimps observable in the cross section, a score of "horizontal" was rendered; a score of "vertical/horizontal" was rendered when these crimps were from 35% up to but not including 55%; and a score of "vertical" was rendered when these crimps were less than 35%.

(6) The Characteristic Value A

The average value of the absolute value of the slope with respect to the length direction of the fiber bundle of the straight line that connects the vertex of the peak with the vertex of the valley of adjacent crimps present in a single continuous fiber, for fifty randomly selected points in the fiber bundle photographed with, for example, a microscope.

(7) Bundlability of the Fiber Bundle

The status and location of breakage of the fiber bundle (split into some small bundles) was observed in 1 m of the fiber bundle. The following evaluation scale was used: excellent for 0 to 2 completely split locations where breakage of the fiber bundle has been occurred; poor for 3 or more such locations.

(8) Pull Up Behavior

The fiber bundle was introduced into a 50 cm×50 cm×50 cm packing container while being shaken right and left, and unloading was carried out after 10 kg had been loaded in 5 minutes. This fiber bundle was pulled up vertically at the rate of 15 m/min, at which time the occurrence of entanglement and coiling by the fiber bundle was observed. An evaluation of excellent was rendered when the number of defects produced in 5 minutes was 0 to 2, while an evaluation of poor was rendered for 3 or more.

(9) Spreading Behavior of the Fiber Bundle

The spreading coefficient defined as follows was used as an index showing the spreading behavior of the fiber bundle of the present invention.

$$\text{spreading coefficient } (K) = B/A$$

A: width (unit: mm) of the fiber bundle prior to the spreading treatment

B: width (unit: mm) of the web obtained by spreading the fiber bundle when, using a pinch roll-type spreading machine, the bundle fiber was draw-spread at 1.4× and a line final velocity of 25 m/min and this drawing tension was subsequently released.

(10) Web Uniformity

Using a pinch roll-type spreading machine, a web was obtained by spreading the fiber bundle by draw-spreading the bundle fiber at 1.4× and a line final velocity of 25 m/min and subsequently releasing this drawing tension. The uniformity of the thickness of this web and the presence/absence of unspread fiber bundle was evaluated on a four level scale, i.e., (good) A>B>C>D (poor).

Example 1

An undrawn 10.8 dtex filament was obtained by conjugate melt-spinning high density polyethylene and polyethylene terephthalate at a mass ratio of 50:50 using a sheath-core nozzle. These undrawn 31,000 filaments were bundled and this was drawn by 3.6 of drawing ratio with a hot-roll drawing machine heated to 90° C. followed by the introduction of crimps at 15.3 peaks/2.54 cm using a 20 mm-wide crimper that had the ability to apply stress from the width direction that made possible a content of 35% or more of crimps having peaks/valleys in the width direction. A dry heat treatment at 110° C. was then carried out to obtain a fiber bundle with a single filament fineness of 3.5 dtex and a total fineness of 107,000 dtex.

The crimps in this fiber bundle formed peaks/valleys mainly in the width direction of the fiber bundle; the characteristic value A was 1.99; and the bundlability and pull up behavior were both excellent. When this was spread by 1.4 of drawing ratio at 25 m/min, the continuous fibers were uniformly spread in the width direction; unspread fiber bundle was also not present; and a web with an excellent handle was formed. The spreading coefficient was 10.5.

Example 2

An undrawn 10.8 dtex filament was obtained by conjugate melt-spinning high density polyethylene and polypropylene at a mass ratio of 50:50 using a sheath-core nozzle. These undrawn 24,000 filaments were bundled and this was drawn by 4.0 of drawing ratio with a hot-roll drawing machine heated to 90° C. followed by the introduction of crimps at 15.3 peaks/2.54 cm using the same crimper as in Example 1. A dry heat treatment at 110° C. was then carried out to obtain a fiber bundle with a single filament fineness of 2.8 dtex and a total fineness of 70,000 dtex.

The crimps in this fiber bundle formed peaks/valleys in the width direction of the fiber bundle and in the thickness direction of the fiber bundle; the characteristic value A was 1.61; and the bundlability and pull up behavior were both excellent. When this was spread 1.4× at 25 m/min, the continuous fibers were uniformly spread in the width direction; unspread fiber bundle was also not present; and a web with an excellent handle was formed. The spreading coefficient was 8.4.

Example 3

An undrawn 10.8 dtex filament was obtained by conjugate melt-spinning high density polyethylene and polyethylene terephthalate at a mass ratio of 50:50 using a sheath-core nozzle. These undrawn 25,000 filaments were bundled and this was drawn by 3.6 of drawing ratio with a hot-roll drawing machine heated to 90° C. followed by the introduction of crimps at 15.3 peaks/2.54 cm using the same crimper as in Example 1. A dry heat treatment at 110° C. was then carried out to obtain a fiber bundle with a single filament fineness of 3.6 dtex and a total fineness of 89,000 dtex.

The crimps in this fiber bundle formed peaks/valleys mainly in the width direction of the fiber bundle; the characteristic value A was 2.17; and the bundlability and pull up behavior were both excellent. When this was spread by 1.4 of drawing ratio at 25 m/min, the continuous fibers were uniformly spread in the width direction; unspread fiber bundle was also not present; and a web with an excellent handle was formed. The spreading coefficient was 8.7.

Example 4

An undrawn 8.6 dtex filament was obtained by conjugate melt-spinning high density polyethylene and polyethylene terephthalate at a mass ratio of 40:60 using a sheath-core nozzle. These undrawn 25,000 filaments were bundled and this was drawn by 2.9 of drawing ratio with a hot-roll drawing machine heated to 90° C. followed by the introduction of crimps at 14.8 peaks/2.54 cm using the same crimper as in Example 1. A dry heat treatment at 110° C. was then carried out to obtain a fiber bundle with a single filament fineness of 3.3 dtex and a total fineness of 83,000 dtex.

The crimps in this fiber bundle formed peaks/valleys mainly in the width direction of the fiber bundle; the characteristic value A was 1.25; and the bundlability and pull up behavior were both excellent. When this was spread by 1.4 of drawing ratio at 25 m/min, the continuous fibers were uniformly spread in the width direction and a web with an excellent handle, although not up to that in Examples 1 to 3, was formed. The spreading coefficient was 6.1.

Example 5

An undrawn 35.2 dtex filament was obtained by conjugate melt-spinning high density polyethylene and polyethylene terephthalate at a mass ratio of 50:50 using a sheath-core nozzle. These undrawn 22,000 filaments were bundled and this was drawn by 4.0 of drawing ratio with a hot-roll drawing machine heated to 95° C. followed by the introduction of crimps at 15.5 peaks/2.54 cm using a 35 mm-wide crimper that had the ability to apply stress from the width direction that made possible a content of 35% or more of crimps having peaks/valleys in the width direction. A dry heat treatment at 110° C. was then carried out to obtain a fiber bundle with a single filament fineness of 10.0 dtex and a total fineness of 224,000 dtex.

The crimps in this fiber bundle formed peaks/valleys mainly in the width direction of the fiber bundle; the characteristic value A was 1.64; and the bundlability and pull up behavior were both excellent. When this was spread by 1.4 of drawing ratio at 25 m/min, the continuous fibers were uniformly spread in the width direction and a web was formed that had an excellent handle, which was about the same as in Example 4 but not up to that in Examples 1 to 3. The spreading coefficient was 8.0.

Example 6

An undrawn 7.4 dtex filament was obtained by conjugate melt-spinning high density polyethylene and polyethylene terephthalate at a mass ratio of 50:50 using a sheath-core nozzle. These undrawn 32,000 filaments were bundled and this was drawn by 2.9 of drawing ratio with a hot-roll drawing machine heated to 90° C. followed by the introduction of crimps at 14.5 peaks/2.54 cm using a 20 mm-wide crimper that had the ability to apply stress from the width direction that made possible a content of 35% or more of crimps having peaks/valleys in the width direction. A dry heat treatment at 110° C. was then carried out to obtain a fiber bundle with a single filament fineness of 2.9 dtex and a total fineness of 94,000 dtex. The crimps in this fiber bundle formed peaks/valleys mainly in the width direction of the fiber bundle; the characteristic value A was 0.58; and, while the bundlability was inferior to that in Examples 1 to 5, the pull up behavior was excellent. When this was spread by 1.4 of drawing ratio at 25 m/min, there was some unspread fiber bundle, but uniform spreading occurred in the width direction to a degree fit for use and a web was formed that had an excellent handle, although not up to that in Examples 1 to 5. The spreading coefficient was 3.6.

Comparative Example 1

Undrawn filament was obtained as in Example 1. This was drawn as in Example 1; however, the crimps were introduced using a 20 mm-wide crimper that did not have a plate that, in addition to the thickness direction of the fiber bundle, also applied pressure in the width direction of the fiber bundle. A fiber bundle was obtained that had a single filament fineness of 3.5 dtex, a crimp count of 14.3 peaks/2.54 cm, and a total fineness of 107,000 dtex.

The crimps in this fiber bundle formed peaks/valleys mainly in the thickness direction of the fiber bundle; the characteristic value A was 0.17; the bundlability was significantly reduced; and many pull up defects were produced. When this was spread by 1.4 of drawing ratio at 25 m/min, there was almost no spreading in the width direction; there was much unspread fiber bundle; and a web having a handle fit for use was not obtained. The spreading coefficient here was 1.8.

Comparative Example 2

An undrawn filament was obtained as in Example 3. This was drawn as in Example 3 to obtain a fiber bundle with a single filament fineness of 3.6 dtex, a crimp count of 15.0 peaks/2.54 cm, and a total fineness of 89,000 dtex. However, when crimping was introduced with a high-speed crimper, adequate pressure could not be applied in the thickness direction of the fiber bundle and as a consequence, while the crimps in the fiber bundle formed peaks/valleys mainly in the width direction of the fiber bundle, the characteristic value A was low at 0.25 and the desired effects of the present invention could not be obtained. The characteristic value A being 0.25, the bundlability was low and pull up defects were produced. When this was spread 1.4× at 25 m/min, some spreading did occur in the width direction, but there was much unspread fiber bundle and a web fit for use was not obtained. The spreading coefficient here was 2.4.

The results obtained in the preceding Examples 1 to 6 and Comparative Examples 1 and 2 are shown below in Tables 1 and 2.

TABLE 1

| | Example 1 | Example 2 | Example 3 | Example 4 |
|---|---|---|---|---|
| fiber type | HDPE/PET sheath-core type conjugate fiber | HDPE/PP sheath-core type conjugate fiber | HDPE/PET sheath-core type conjugate fiber | HDPE/PET sheath-core type conjugate fiber |
| single filament (dtex) | 3.5 | 2.8 | 3.6 | 3.3 |
| single filament strength (cN/dtex) | 1.95 | 3.54 | 1.60 | 1.85 |
| total fineness (several ten thousand dtex) | 10.7 | 7.0 | 8.9 | 8.3 |
| crimp count (peaks/2.54 cm) | 15.3 | 16.0 | 15.3 | 14.8 |
| crimp direction | horizontal | vertical/ horizontal | horizontal | horizontal |
| characteristic value A | 1.99 | 1.61 | 2.17 | 1.25 |
| bundlability of the fiber bundle | excellent | excellent | excellent | excellent |
| pull up behavior | excellent | excellent | excellent | excellent |
| spreading coefficient | 10.5 | 8.4 | 8.7 | 6.1 |
| uniformity of the spread web | A | A | A | B |

TABLE 2

| | Example 5 | Example 6 | Comparative Example 1 | Comparative Example 2 |
|---|---|---|---|---|
| fiber type | HDPE/PET sheath-core type conjugate fiber | HDPE/PET sheath-core type conjugate fiber | HDPE/PET sheath-core type conjugate fiber | HDPE/PET sheath-core type conjugate fiber |
| single filament (dtex) | 10.0 | 2.9 | 3.5 | 3.6 |
| single filament strength (cN/dtex) | 2.23 | 3.12 | 1.87 | 1.72 |
| total fineness (several ten thousand dtex) | 22.4 | 9.4 | 10.7 | 8.9 |
| crimp count (peaks/2.54 cm) | 15.5 | 14.5 | 14.3 | 15.0 |
| crimp direction | horizontal | horizontal | vertical | horizontal |
| characteristic value A | 1.64 | 0.58 | 0.17 | 0.25 |
| bundlability of the fiber bundle | excellent | somewhat poor | poor | poor |
| pull up behavior | excellent | excellent | poor | poor |
| spreading coefficient | 8.0 | 3.6 | 1.8 | 2.4 |
| uniformity of the spread web | B | C | D | D |

The invention claimed is:

1. A fiber bundle comprising crimped continuous fibers aligned in one direction, wherein the crimped continuous fibers have crimps that form peaks and valleys in a width direction of the fiber bundle, crimps of the crimped continuous fibers have a characteristic value A of at least 0.3, wherein the characteristic value A is defined as an absolute value of a slope, with respect to a length direction of the fiber bundle, of a straight line that connects a vertex of the peak with a vertex of the valley of crimps adjacent to each other present in a single continuous fiber, the fiber bundle has a spreading coefficient (K) in a range from 3.6 to 10.5, wherein the spreading coefficient (K) is represented by a formula:

$$\text{the spreading coefficient } (K)=B'/A',$$

where A' is a width (mm) of the fiber bundle having not been subjected a spreading treatment, and B' is a width (mm) of a web formed by spreading the fiber bundle when using a pinch roll-type spreading machine, the bundle fiber is draw-spread at 1.4 times and a line final velocity of 25 m/min and this drawing tension is subsequently released, a crimp count in the crimped continuous fiber is in a range from 12 to 18 peaks/2.54 cm, the crimps are present continuously in the length direction of the fiber bundle, the fiber bundle comprises crimps that form the peaks and the valleys in the width direction of the fiber bundle at least 55% as a number of the crimps relative to a number of crimps in the whole fiber bundle, and single filament fineness of the fibers forming the fiber bundle is in a range from 0.5 to 100 decitex (dtex).

2. The fiber bundle according to claim 1, wherein the characteristic value A of the crimps formed in the width direction of the fiber bundle is at least 1.0.

3. The fiber bundle according to claim 1, wherein total fineness of the fiber bundle is from 5,000 to 2,000,000 decitex (dtex).

4. The fiber bundle according to claim 1, wherein the fiber forming the fiber bundle is at least one thermoplastic fiber selected from the group consisting of polyolefin fibers, polyester fibers, and polyamide fibers.

5. The fiber bundle according to claim 1, wherein the fiber forming the fiber bundle is a conjugate fiber that contains at least two thermoplastic resin components that have melting points that differ by at least 15° C. from each other.

6. The fiber bundle according to claim 1, wherein the fiber bundle is a continuous fiber bundle in which the crimped continuous fibers contact each other along the length direction of the fiber bundle.

* * * * *